US006176407B1

(12) United States Patent
Jones et al.

(10) Patent No.: US 6,176,407 B1
(45) Date of Patent: Jan. 23, 2001

(54) AMMUNITION POUCH AND METHOD OF USING THE SAME

(75) Inventors: Brent Jones; Phillip Durham, both of Greer, SC (US)

(73) Assignee: Innovative Sports, Inc., Greer, SC (US)

( * ) Notice: Under 35 U.S.C. 154(b), the term of this patent shall be extended for 0 days.

(21) Appl. No.: 09/252,539

(22) Filed: Feb. 18, 1999

(51) Int. Cl.[7] ..... A45C 15/00

(52) U.S. Cl. ..... 224/584; 224/223; 224/250; 224/931

(58) Field of Search ..... 224/584, 586, 224/150, 904, 931, 251, 587, 918, 223, 219, 222, 250; D3/224, 225, 230

(56) References Cited

U.S. PATENT DOCUMENTS

| | | | | |
|---|---|---|---|---|
| D. 270,784 | * | 10/1983 | Forreste | D3/37 |
| D. 329,327 | | 9/1992 | Haltzclaw, Jr. . | |
| 2,346,185 | * | 4/1944 | Perry | 224/223 |
| 2,566,569 | | 9/1951 | Jensen . | |
| 3,272,412 | * | 9/1966 | Antonious | 224/223 |
| 4,047,650 | * | 9/1977 | Domingos | 224/223 |
| 4,069,954 | * | 1/1978 | Rauch | 224/223 |
| 4,262,833 | * | 4/1981 | DeSantis | 224/239 |
| 4,299,343 | * | 11/1981 | Atchisson | 224/149 |
| 5,009,346 | * | 4/1991 | Butler | 224/605 |
| 5,121,564 | * | 6/1992 | Story | 42/90 |
| 5,127,565 | | 7/1992 | Grant . | |
| 5,772,090 | * | 6/1998 | Rodriguez | 224/251 |
| 5,797,140 | | 8/1998 | Davis et al. . | |

OTHER PUBLICATIONS

Cabela's Master Catalog—Fall 1999–2nd edition—p. 457 Cartridge Carriers illustrative of items in use at least as early as Oct. 1, 1998.

* cited by examiner

*Primary Examiner*—Stephen K. Cronin
*Assistant Examiner*—Maerena W. Brevard
(74) *Attorney, Agent, or Firm*—Dority & Manning, P.A.

(57) ABSTRACT

An ammunition pouch 10 for carrying and protecting ammunition having a tubular shaped, resilient, elastic body 20 that is adaptable to be worn either slipped over a belt 130, the end of a firearm 120 or carried freely. The body 20 has an upper flap 30 for opening or closing access to the ammunition 140; a number of retaining slots 100 for retaining individual pieces of ammunition 140 such as shells; a rear pocket 150 for storing other paraphernalia such as a lighter, keys or sunglasses; and a connecting means 90 such as VELCRO® for closing and protecting the pouch 10. The pouch 10 is constructed of a lightweight, waterproof, camouflage print material.

10 Claims, 4 Drawing Sheets

AMMUNITION POUCH AND METHOD OF USING THE SAME

BACKGROUND OF THE INVENTION

1. Field of Invention

The present invention relates to the art of Ammunition Pouches. More particularly, this invention is related to an ammunition pouch that permits ammunition to be transported and carried either on a user's belt, carried freely, or attached to a firearm. The ammunition pouch is lightweight, flexible, and protects the ammunition and other paraphernalia from the elements.

2. Description of Prior Art

U.S. Pat. No. Des. 3,293,27, issued to Holtzclaw. Jr., shows a softsided carrying case having an upper flap and inner divider. This case does not show specific dividers for individual shells nor is it attachable to a belt or firearm.

U.S. Pat. No. 2,566,569, issued to Jensen, discloses a cartridge case that has individual dividers for holding numerous shells individually, an upper flap, and is capable of being attached to a user's belt. However, this case does not have pockets for holding items other than the ammunition and it cannot be attached to a firearm.

U.S. Pat. No. 5,127,565, issued to Grant, shows an ammunition dispensing garment having pockets for holding ammunition. This garment is a vest and cannot be attached to a belt or a firearm but instead must be worn separately on the user's body.

U.S. Pat. No. 5,797,140, issued to Davis et al., discloses a pack that is mounted on a belt and has an attachable ammunition pouch. This particular garment is designed to be worn for police protection and includes a ballistic resistant panel. The ammunition pouch is mounted to a panel of the garment but is limited in the quantity of ammunition that is capable of being stored and is not capable of being mounted on a firearm.

While the above stated devices are a fair representation of existing devices, there remains room for improvement as defined by the currently claimed invention.

SUMMARY OF THE INVENTION

It is thus an objective of the present invention to provide a means for carrying and storing ammunition.

It is a further objective of the invention to provide means for carrying ammunition that is adaptable to be worn on a belt or strap.

It is yet another objective of the invention to provide an ammunition pouch which is easily transpotable.

It is an additional objective of the invention to provide an ammunition pouch that can be attached to a firearm.

Another objective of the present invention is to provide an ammunition pouch that may be used to protect ammunition during storage and transport.

A further objective of the present invention is to have an ammunition pouch that is lightweight, waterproof, and folds to a reduced size for storage when not in use.

Yet another objective of the present invention is to provide a protective cover for carrying and transporting other items along with ammunition.

An objective of this ammunition pouch is also to allow for the pouch to be removably attached to a firearm without permanently defacing or damaging the firearm.

And another objective of this invention is to allow for a protective covering for ammunition that may be attached to a firearm while the firearm is in use.

The aforementioned objectives will be accomplished as well as other features and advantages of the present invention will become more apparent from the following detailed description of an ammunition pouch having a tubular shaped, resilient, elastic body that is adaptable to be worn either slipped over a belt or the end of a firearm. The body has a flap for closing off access to the ammunition; a number of retaining slots for retaining individual pieces of ammunition such as shells; a rear pocket for storing other paraphernalia such as a lighter, keys, or sunglasses; a mating closure means such as VELCRO® for closing and protecting the pouch; and the pouch is constructed of a lightweight, waterproof, and preferably camouflage material. The description of the present invention discloses, in conjunction with the drawings which illustrate by way of example, the principles and objectives of the invention.

DETAILED DESCRIPTION

Figure 1:
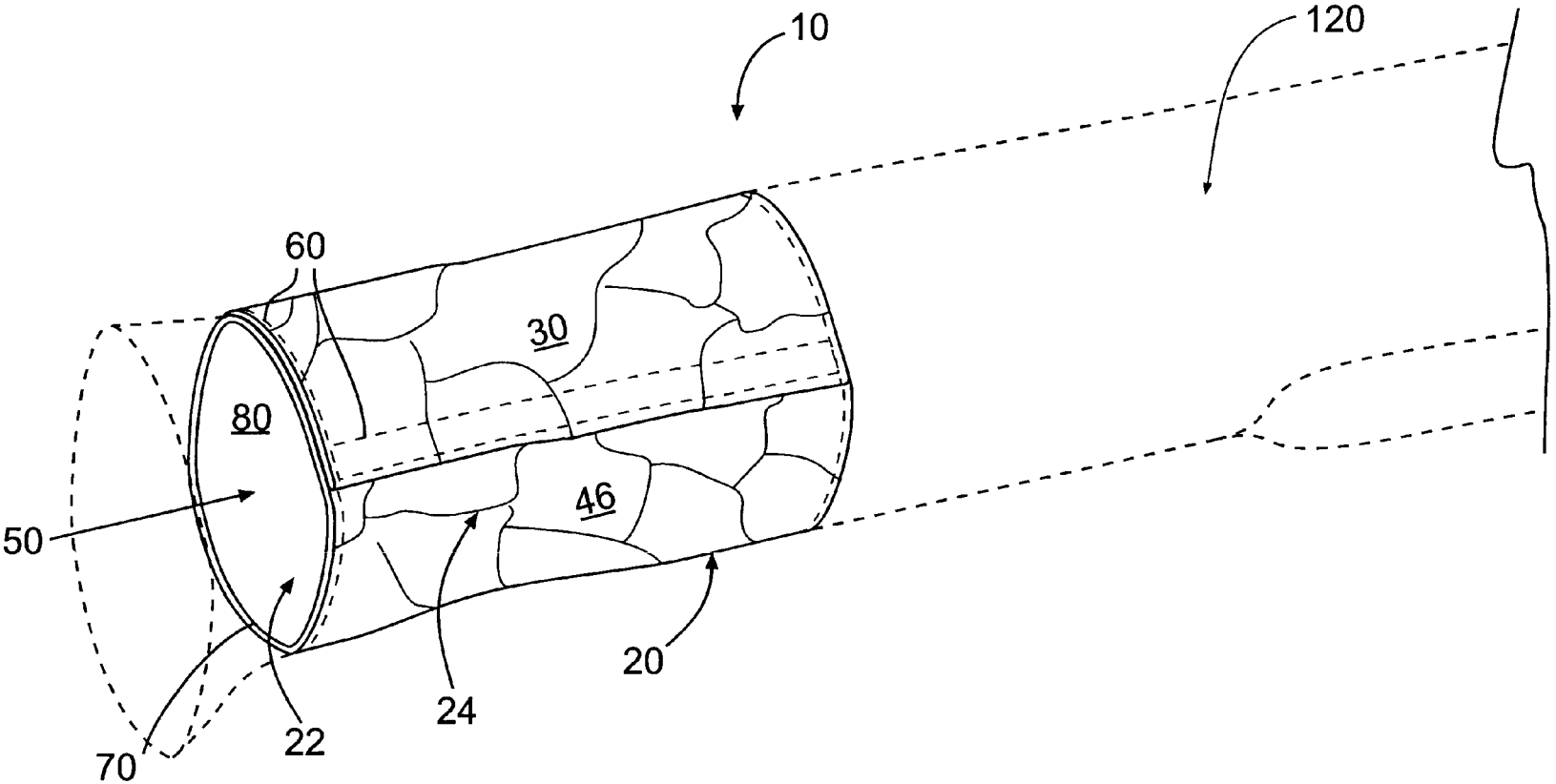
FIG. 1 is a front perspective view of an ammunition pouch with the flap in the closed position and the pouch is placed on the end of a firearm shown in broken lines.

FIG. 1 is a perspective view of an ammunition pouch 10 with a flap 30 that is in a closed position while the ammunition pouch 10 is placed on the end of a firearm 120. The ammuntion pouch 10 has a body 20 defining an inner sleeve 22 having an opening on each end of the tube and an outer shell 24. The inner sleeve 22 is made of a resilient material such as an elastic material while the outer shell 24 is made of a waterproof, lightweight material such as GORTEX® fabric, vinyl, or sturdy canvas treated with a water repellant finish. The outer shell 24 is preferably made of a camouflage print. Also, waterproof, water resistant, and laminated fabrics can be used to make the ammunition pouch 10. While the camouflage print is the print of choice in the preferred embodiment, any color or combination thereof is acceptable.

The inner sleeve 22 forms a hollow core 50 through which a firearm 120 or belt 130 can be inserted in order to secure the ammunition pouch 10 for carrying purposes. The ammunition pouch 10, having the resilient inner sleeve 22 can easily be mounted on a firearm 120 as shown in FIG. 1. The resilient material, such as an elastic material, allows the inner sleeve 22 to be stretched to slide over the end of the firearm 120 and then placed in the desired location on the firearm. The elasticity of the material allows the diameter of the hollow core 50 to expand when being mounted. After being positioned, the elasticity constricts the diameter of the hollow core 50 so that the inner sleeve 22 will snugly grip or hold the firearm 120 and not slide off until purposefully removed from the firearm 120 by the user. Furthermore, mounting the ammunition pouch 10 on the end of the firearm 120 allows for the ammunition to be carried along with the firearm 120 easily and conveniently. Also, if the ammunition pouch 10 is placed on the butt end of a firearm 120, the firearm 120 can still be operated while the ammunition pouch 10 is in place without the ammunition pouch 10 causing any interference to the operation of the firearm 120. The ammunition pouch 10 can be located over the end of the firearm 120, even while the firearm 120 is inside a firearm casing or cover.

When the flap 30 is in the closed position, as in FIG. 1, it is removably connected to the front portion 46 of the outer shell 24 by connecting means 90 (FIG. 3), which is preferably comprised of hook and loop fasteners such as VELCRO®. Connecting means 90 can also be made of buttons, snaps, hooks, or any other conventional connecting means known in the art. The connecting means 90 (FIG. 3) allows for the ammunition pouch 10 to be easily and quickly opened and closed with one hand and with relatively little effort or energy. When in the closed position, the flap 30 secures the ammunition pouch 10 and prevents any of the stored items within the ammunition pouch 10 from being removed or falling out.

Figure 2:
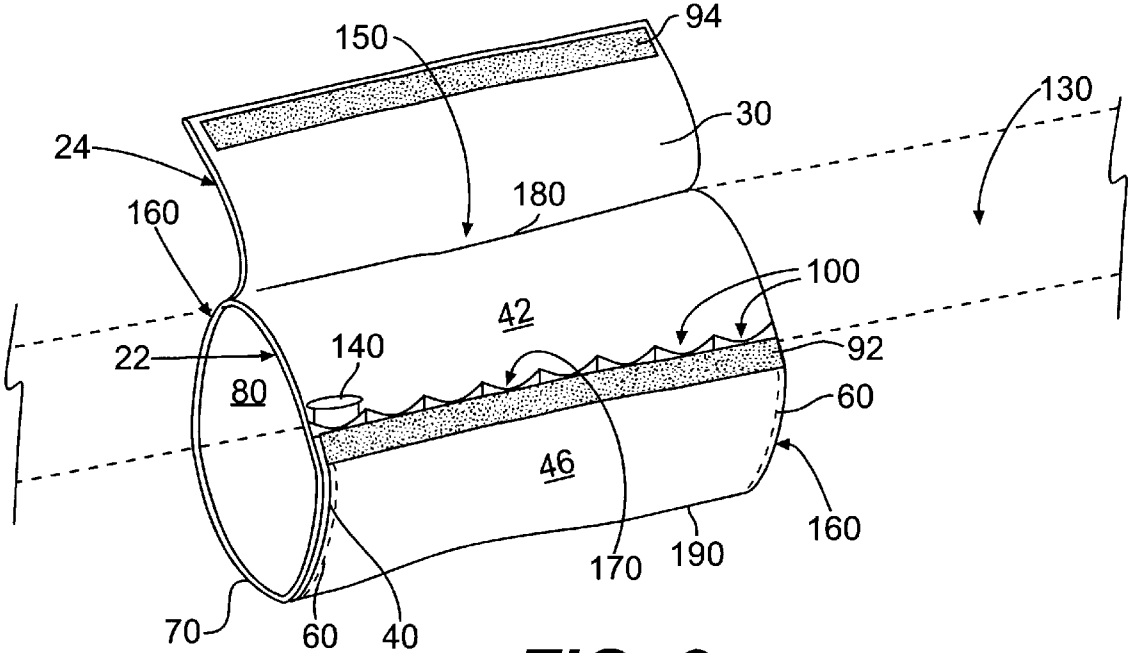
FIG. 2 is a front perspective view of an ammunition pouch showing the flap in the open position to expose the ammunition slots and showing the pouch attached to a portion of a belt (shown in broken lines).
Figure 4:
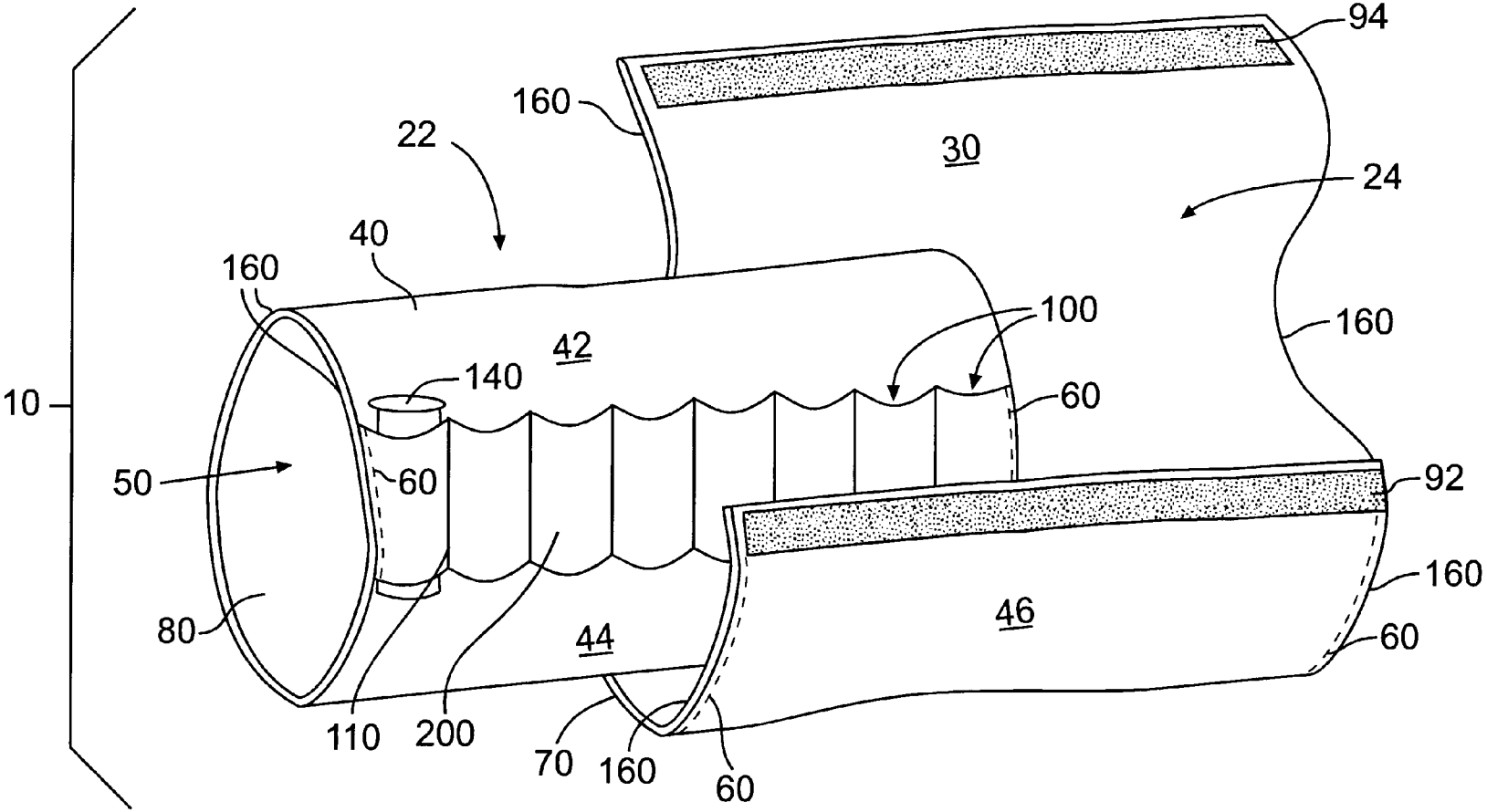
FIG. 4 is an exploded view of an ammunition pouch showing how the sleeve fits within the outer shell.

FIG. 2 is a front perspective view of the ammunition pouch 10 showing the flap 30 in the open position to expose the ammunition slots 100. The ammunition pouch 10 is attached to a portion of the belt 130 shown in broken lines. The inner sleeve 22 has a front panel 40 and a rear panel 80. As shown in FIG. 4, the front panel 40 has an upper portion 42 and a lower portion 44. The outer shell 24 wraps around the inner sleeve 22 and also has a shell front portion 46 which covers the lower portion 44 of the inner sleeve 22 and which can be matingly attached with flap 30 when the ammunition pouch is in the closed position using connecting means 90. The outer shell 24 and the inner sleeve 22 are permanently connected to one another at their outer edges 160 by conventional means such as sewing or gluing, the preferred method being stitching (shown in FIG. 1). This connection allows the shell front portion 46 to form a front pocket 170 with an access as shown in FIG. 2. The front pocket 170 has edges stitched as previously described and has a bottom formed by the fold, bends, or curve in the sleeve 22 such as is shown along the lower portion depicted in the drawings as a line 190. Within the front pocket 170, the slots 100 are located which hold the ammunition 140. The slots 100 are more fully described below with reference to FIG. 4.

The back panel 70 of the outer shell 24 may also be configured to form a rear pocket 150 with the rear panel 80 of the inner sleeve 22. The rear pocket 150 is larger than the front pocket 170 and can be used to hold various items and other hunting paraphernalia. The rear pocket 150 is stitched along both outer edges 160 and the bottom is also formed by the fold or curve of the body 20 such as shown along line 190.

Figure 3:
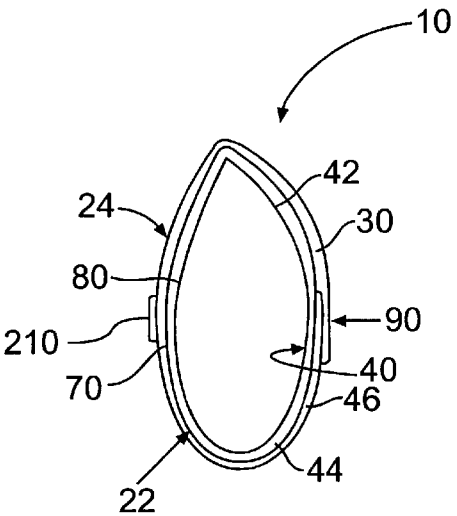
FIG. 3 is a side elevation view of an ammunition pouch showing the flap in the closed position.

Attached at the top edge of flap 30 is a connecting means 90 (FIG. 3). In the preferred embodiment, the connecting means is of a mating type such as hook and loop fasteners and therefore, the outer connector 94 is sewn or glued to flap 30. The outer connector 94 matingly connects with an inner connector 92 which is attached by conventional means such as sewing or gluing, to the shell front panel 46. Therefore, when the ammunition pouch 10 is in the open position and accessible, outer connector 94 is removed from being connected to inner connector 92 and the flap 30 is lifted or raised. A second inner connector 210 (FIG. 3) may be attached to the rear of the ammunition pouch 10 on the outside of the rear pocket 150 so as to enable the flap 30 to be folded back and attached to the second inner connector 210, thus securing the flap 30 in a fixed position. When the ammunition pouch 10 is in the closed position, the outer connector 94 is matingly connected with inner connector 92 by lowering flap 30 over the upper portion 42 of the inner sleeve 22. When in the closed position, the outer shell 24 is essentially wrapped around and encases the inner sleeve 22, trapping between the inner sleeve 22 and the outer shell 24 any such items such as ammunition 140 that may be placed within the front pocket 170, rear pocket 150, or both. The ammunition pouch 10 can be worn on a belt 130 simply by inserting one end of the belt 130 through the hollow core 50 until it exits through the opposite end or through belt loops 220 such as described in reference to FIG. 5. The ammunition pouch 10 may also be freely carried. If it is empty, it is flexible enough to be folded and placed in the user's pocket or firearm casing until needed.

FIG. 3 is a side elevation view of the ammunition pouch 10 showing the flap 30 in the closed position. The ammunition pouch 10 is actually a layering of the outer shell 24 upon the inner sleeve 22. This side elevation depicts the relationship between 1) the outer shell 24 and its elements (such as flap 30, connecting means 90, shell front portion 46 and the inner sleeve 22 and 2) its elements (such as front panel 40, which is comprised of the upper portion 42 and the lower portion 44). Also shown in FIG. 3 is the layering effect and relationship of the back panel 70 of the outer shell 24 and the rear panel 80 of the inner sleeve 22.

While the cross-sectional shape of the ammunition pouch 10 is shown throughout the drawings to be somewhat elliptical, this is merely for illustrative purposes. The resilient nature of the material allows for the cross-sectional shape to take on many geometrical shapes such as, but not limited to, circular, rectangular, square, oblong, diamond, and triangular as well as asymmetrical shapes. For example, when the ammunition pouch 10 is positioned on the end of a firearm 120, the cross-sectional shape of the ammunition pouch 10 will become the same as the cross-sectional shape of the end of the firearm 120, which may not be a common geometric shape. It is possible for the firearm 120 to have certain and specific contours that would dictate the cross-sectional shape of the ammunition pouch 10 when in place.

FIG. 4 is an exploded view of the ammunition pouch 10 showing how the inner sleeve 22 fits within the outer shell 24. The inner sleeve 22 has a front panel 40 and a rear panel 80. The front panel 40 has an upper portion 42 and a lower portion 44. The outer shell 24 wraps around the sleeve 22 and is permanently connected along the outer edges 160 of both the outer shell 24 and the inner sleeve 22 by stitching 60, gluing, or any other conventional connecting means known in the art. The outer shell 24 has a shell portion 46 that can be matingly attached with flap 30 by connecting means 90. Connecting means 90 is comprised of outer connector 94 and inner connector 92, as previously described, and is connected together when the ammunition pouch 10 is in the closed position as shown in FIG. 1. The inner sleeve 22 is one continuous piece of elastic or resilient material that forms a tubular shape having a hollow core 50. The upper portion 42 and the lower portion 44 of the front panel 40 are integrally connected with the rear panel 80. Extending across the width of the front panel 40 is at least one row, and more may be possible, of slots 100 for holding ammunition 140 or other items such as knives, camera film, matches, and etc. The slots 100 are formed from a separate material strip 200 being attached to the inner sleeve 22. The same type of flexible, resilient material, such as an elastic material, that is used to make the inner sleeve 22 should be used to make the material strip 200. The material strip 200 is divided into separate slots 100 by dividers 110, which are stitches sewn in parallel lines, running from top to bottom and extending across the entire width of the material strip 200 and forming individual slots 100 that are wide enough to hold ammunition 140 and other paraphernalia. When in use, the ammunition 140 is inserted into a slot 100. The resilient nature of the material strip 200 allows for the slot 100 to be stretched or expanded while the ammunition 140 is being inserted into the slot 100 and then recoils or constricts to snugly hold and form fit around the ammunition 140 keeping it in place. Each slot is open on the top and the bottom thereby allowing items to be inserted or removed within the slot 100 either from the top or bottom.

Figure 5:
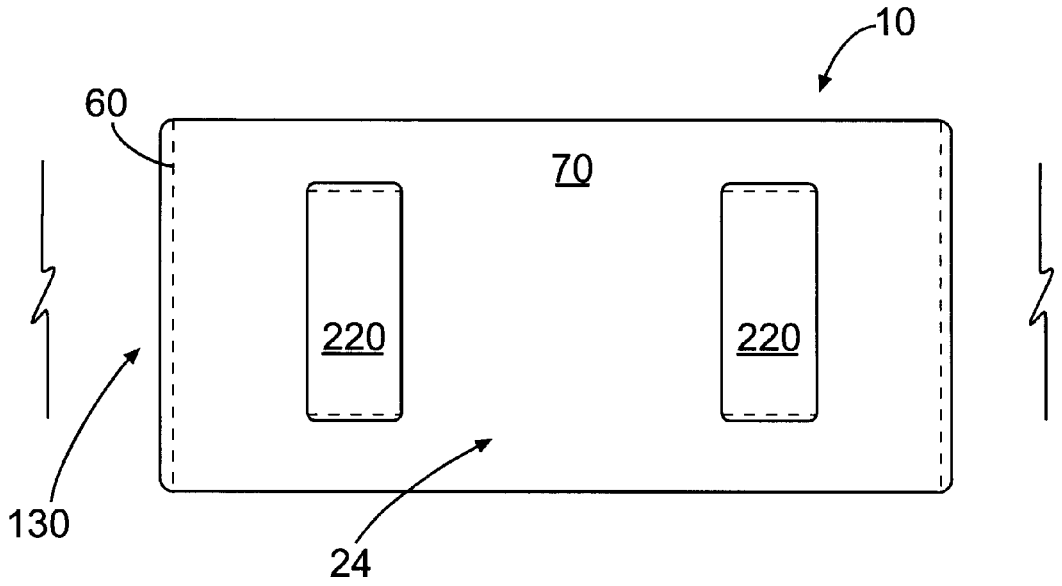
FIG. 5 is a rear elevation view of an ammunition pouch showing a belt through belt loops. The broken line depicting the belt is for illustrative purposes only and forms no part of the claimed invention.

FIG. 5 is a rear elevation view of the ammunition pouch 10. The ammunition pouch 10 may be made with belt loops 220 on the back panel 70 of the outer shell 24. Such belt loops 220 are of a conventional type, such as one large strap or numerous smaller straps, such as two, placed parallel to one another and attached to the outside of the back panel 70 through conventional means such as stitching 60, gluing, riveting, and etc. The user wears the belt 130 in a normal fashion with the ammunition pouch 10 attached thereto. Such method of wearing the ammunition pouch 10 allows the user to freely and easily access the ammunition pouch 10 when desired, yet it is out of the way otherwise and does not require the user to constantly hold it.

The ammunition pouch 10 described herein and illustrated in the drawings is subject to other advantages and modifications that may be apparent to those of ordinary skill in the art without departing from the spirit and scope of the appended claims. Accordingly, the invention is to be limited only by the scope of the following claims and their equivalents.

What is claimed is:

1. An ammunition pouch for carrying and protecting ammunition for a firearm, comprising:

a body, said body having an inner sleeve and an outer shell, said inner sleeve is constructed from a resilient material in a tubular shape that is configured to receive therein the end of a firearm, said outer shell having a shell front portion and being made of a lightweight material, said outer shell being wrapped around said inner sleeve and connected to said inner sleeve at the ends of said inner sleeve such that the space between said inner sleeve and said outer shell forms a rear pocket configured for storing items;

a number of retaining slots carried by said body between said outer shell and said inner sleeve and configured for holding ammunition within the ammunition pouch;

a flap attached to said outer shell and configured for selectively opening and closing access to ammunition stored in the ammunition pouch; and connecting means, located upon said flap and said outer shell, for closing and protecting ammunition stored in the ammunition pouch.

2. An ammunition pouch as in claim 1, further comprising at least one belt loop attached to said body, whereby the pouch may be carried on a belt.

3. An ammunition pouch as in claim 1, wherein said retaining slots are constructed of a resilient material.

4. An ammunition pouch as in claim 1, wherein said body is constructed of a waterproof material.

5. An ammunition pouch as in claim 1, wherein said body is constructed of a water resistant material.

6. An ammunition pouch as in claim 1, wherein said flap is constructed of a waterproof material.

7. An ammunition pouch as in claim 1, wherein said flap is constructed of a water resistant material.

8. An ammunition pouch as in claim 1, wherein said body includes a camouflage print.

9. An ammunition pouch as in claim 1, wherein said flap includes a camouflage print.

10. A method of carrying ammunition comprised of the following steps:

providing an ammunition pouch having a body with a tubular shaped, resilient, inner sleeve and an outer shell being made of a lightweight, waterproof, camouflage material and having a shell front portion; an upper flap for opening or closing access to ammunition stored in a number of retaining slots; a rear pocket for storing other items; and a connecting means for closing and protecting said ammunition pouch; wherein said outer shell wraps around and is connected to said inner sleeve at the ends of the tubular shaped body such that the area between said inner sleeve and said outer shell forms said rear pocket and allows space for said retaining slots to be located;

expanding said ammunition pouch and placing said pouch over stock end of a firearm;

allowing said ammunition pouch to constrict around said stock end of said firearm;

removably disconnecting said connecting means and raising said upper flap;

sliding ammunition in said retaining slots;

lowering said upper flap and connecting said connecting means; and transporting said ammunition in said ammunition pouch to said desired location.

* * * * *